US006905275B1

(12) United States Patent
Del Valle

(10) Patent No.: US 6,905,275 B1
(45) Date of Patent: Jun. 14, 2005

(54) PEN CARD

(76) Inventor: Michael Del Valle, 95-11 35th Ave., Jackson Heights, NY (US) 11372

( * ) Notice: Subject to any disclaimer, the term of this patent is extended or adjusted under 35 U.S.C. 154(b) by 0 days.

(21) Appl. No.: 10/889,590

(22) Filed: Jul. 12, 2004

(51) Int. Cl.[7] ..... B43K 29/00
(52) U.S. Cl. ..... 401/195; 401/52
(58) Field of Search ..... 401/52, 195; D19/35, D19/38

(56) References Cited

U.S. PATENT DOCUMENTS

| | | | | |
|---|---|---|---|---|
| 568,473 | A * | 9/1896 | Brewer | 33/760 |
| 701,072 | A | 5/1902 | Morris | |
| 1,069,746 | A * | 8/1913 | Watts | 242/564.4 |
| 1,212,020 | A * | 1/1917 | Constant, Jr. | 242/564 |
| 1,545,596 | A * | 7/1925 | Clennan | 242/588.1 |
| 1,561,725 | A | 11/1925 | Kerley | |
| 1,759,596 | A * | 5/1930 | Steudte | 242/379 |
| 1,769,321 | A * | 7/1930 | Toth | 242/379 |
| 2,111,362 | A | 3/1938 | Fisher | |
| 2,508,372 | A | 5/1950 | Carlson | |
| 2,620,143 | A | 12/1952 | Armelin | |
| 4,030,842 | A | 6/1977 | White et al. | |
| 4,872,775 | A | 10/1989 | Chang | |
| 4,963,048 | A | 10/1990 | Thomas et al. | |

FOREIGN PATENT DOCUMENTS

| | | |
|---|---|---|
| EP | 057.554 | 11/1982 |
| GB | 2.106.044 | 4/1983 |
| GB | 2.267.465 | 8/1993 |
| GB | 2.382.800 | 11/2003 |

* cited by examiner

*Primary Examiner*—Gregory L. Huson
*Assistant Examiner*—Huyen Le
(74) *Attorney, Agent, or Firm*—Michael I. Kroll

(57) ABSTRACT

An apparatus for a housing 12 having a longitudinal slot 38 passing therethrough communicating with a housing cavity that has a spool 32 positioned therein with flexible sheet material 24 wound on the spool which is extendable and retractable through the longitudinal slot by means of an exteriorly located clip 18 fastened to the distal end of the flexible sheet material having means for selectively holding the material in the extended position. The device 10 can be manufactured as an integral part of a writing implement of or as an accessory for a writing implement such as a pen cover. The mechanism for extending and retracting the flexible sheet material 24 is not limited to that disclosed in the drawing and can include the mechanism commonly found in window shades.

6 Claims, 10 Drawing Sheets

PEN CARD

BACKGROUND OF THE INVENTION

1. Field of the Invention

The present invention relates generally to rolled material and, more specifically, to a housing having a longitudinal slot passing therethrough communicating with a housing cavity that has a spool positioned therein with flexible sheet material wound on said spool which is extendable and retractable through said longitudinal slot by means of an exteriorly located clip fastened to the distal end of the flexible sheet material having means for selectively holding the material in the extended position.

The aforementioned device, hereinafter referred to as the pen card, can be manufactured as an integral part of a writing implement of as an accessory for a writing implement such as a pen cover.

The mechanism for extending and retracting the flexible sheet material is not limited to that disclosed in the drawing and can include the mechanism commonly found in window shades.

Additionally, the present invention provides means for selectively purchasing various pen caps and/or barrel mechanisms and removably attaching the device to various pen types.

2. Description of the Prior Art

There are other spool devices designed for pens. Typical of these is U.S. Pat. No. 701,072 issued to Morris on May 27, 1902.

Another patent was issued to Kerley on Nov. 17, 1925 as U.S. Pat. No. 1,561,725. Yet another U.S. Pat. No. 2,111,362 was issued to Fisher on Mar. 15, 1938 and still yet another was issued on May 23, 1950 to Carlson as U.S. Pat. No. 2,508,372.

Another patent was issued to Armelin on Dec. 2, 1952 as U.S. Pat. No. 2,620,143. Yet another U.S. Pat. No. 4,030,842 was issued to White, et al. on Jun. 21, 1977. Another was issued to Chang on Oct. 10, 1989 as U.S. Pat. No. 4,872,775 and still yet another was issued on Oct. 16, 1990 to Thomas, et al. as U.S. Pat. No. 4,963,048.

Another patent was issued to Tibbling on Jan. 27, 1981 as E.P. Patent No. EP0 057 554. Yet another U.K. Patent No. GB 2 106 044 was issued to Glover on Apr. 7, 1983. Another was issued to Brien on Dec. 8, 1993 as U.K. Patent No. GB 2 267 465 and still yet another was issued on Jun. 11, 2003 to Masry as U.S. Pat. No. GB 2 382 800.

A device of the class described comprising a cylindrical casing having a longitudinal slot leading from one end thereof, closures removably engaged with the ends of the casing and having bearings therein, a shaft having spaced disks thereon, disposed within the casing with its ends engaged with the bearings, a disk and an end closure having each a struck-up loop, a helical spring disposed upon the shaft and having its ends engaged beneath the loops, and a tape attached to the shaft between the loops and passed outwardly through the slot.

In combination with a pencil, an outside casing, said casing having a longitudinal slot therein, a map within said casing, a. roller having said map attached thereto, a plate, a lip formed thereon adapted to protrude through, the slot, a shaft extending through said, plate and said roller, and means to actuate said roller and map.

An article of the class described comprising in combination, a tubular barrel having an elongated slot in its side wall which opens through one end thereof, a calendar unit including a cylindrical casing snugly fitting into said tubular barrel, a spring actuated winding roller journaled for rotation within said cylindrical casing, said casing having a slot in its side wall in register with the slot in said barrel, a calendar strip having one of its ends fixed to said roller, a stop strip on the outer free end of said calendar strip, said calendar strip extending through both of said slots, and a removable cap carried by that end of said barrel to which the slot therein extends for closing the same.

In a device of the character described including a tubular casing, a longitudinally slotted housing fixed therein being closed at its lower end and open at its upper end, a centrally apertured cap closure member in the upper end of said housing, an annular offset locking socket in said closure member, a shaft supported in said housing for longitudinal movement having a locking shank thereon adapted to be received in said locking socket, a reel on said shaft, a tape measure secured to said shaft wound on said reel and extending through said slot, a clock spring disposed below said housing fixed thereto and to said shaft, and a coil spring disposed about said shaft between the bottom of said housing and said reel for forcing said shaft shank into locking engagement with said offset locking socket.

A device of the character described comprising a housing, a cap removably mounted on one end of said housing closing the end thereof, a hollow spool rotatably mounted in said housing, said spool comprising an elongated barrel portion of relatively large diameter and a second forwardly extended barrel portion of reduced diameter relative to said first-mentioned barrel portion, a pair of spaced annular flanges on said first mentioned barrel portion and defining a chamber therebetween and concentrically of said spool and housing for retaining sheet material adapted to be wound around said spool, a third annular flange integral with said reduced diameter barrel portion and spaced from the adjacent end flange on said larger diameter barrel portion and defining a chamber for accommodating a spring, a coil spring arranged in said last mentioned chamber having one end attached to said housing and the other end to said spool, said reduced diameter barrel portion forming a third chamber between said reduced diameter barrel and housing, means comprising a spring actuated pawl in said third chamber, teeth on said spool adapted to be engaged by said pawl, and a button member carried by said housing and adapted to engage said spring actuated pawl member for disengaging the pawl with said teeth on the spool to permit the spool to revolve and return it to its initial position after the spool is revolved setting up tension in said coil spring.

A combination writing instrument and information storage apparatus including an elongated barrel, an elongated tubular spindle dimensioned to be partially inserted in a first longitudinal chamber provided by the elongated barrel, the tubular spindle providing a third longitudinal chamber therein, means for rotatably securing the elongated tubular spindle within the elongated barrel, an elongated cap element having a second longitudinal chamber therein, means for securing the elongated tubular spindle to the elongated cap element, cartridge type writing means adapted to reside within the coextensive first, second, and third longitudinal chambers, means for extending and retracting the writing means from the elongated barrel, and a flexible sheet fixedly secured to the outer surface of the spindle and extending outwardly through a longitudinal slot provided in the elongated barrel, rotation of the spindle retracting and extending the flexible sheet.

A slip-holding pen includes a slip reel, having a paper roll with its two opposite ends coated and bonded by an adhesive, rotatably mounted in a penholder and a rotating knob clickingly rotating the slip reel to reel off the slip paper as originally wound on the reel through a longitudinal slit which is formed on the penholder having acute wedges formed at the slit to tear the adhesive-bonded slip paper, so that the knob can be rotated to easily unroll the paper slip directly from the pen for an immediate writing use.

A writing instrument A with note paper is disclosed which includes a retractable writing instrument carrier and a paper storage chamber E from which paper may be dispensed through a dispensing slot formed along a substantial portion of a barrel B of the device P. Carrier includes a reservoir of writing medium and a writing point. A thumb operator provides for positioning of the carrier in a writing or retracted position. The carrier also may move axially along a slot to position a spare paper roll in a dispensing position as paper roll.

According to the invention a writing implement having a writing element such as a ball-point cartridge which is retractable within the barrel of the implement incorporates within the barrel a tube which is rotatable around the writing implement and serves as a spool for a length of flexible material which has its inner end attached to such tube and can be drawn out from the scroll via a slot in the barrel. The tube is connected to an exposed part such as the barrel tip or the retraction mechanism plunger so that the material can be rewound into the implement by rotating that part. The material is preferably of plastics or other durable material. It can bear advertising or other readable matter and/or be suitable for writing on.

In order to provide a ready-to-hand supply of writing material, a pen or the like carries a stack of paper in a hopper within a housing at the end of the pen opposite the tip. The paper can be withdrawn from hopper through a slot in the housing. A pen which dispenses paper from a roll is also disclosed.

A pen combined with a paper dispenser comprises a lower portion, having a refillable ink cartridge, screw threaded at with an upper portion having a paper roll secured to a spindle. The end of the roll is dispensed through the slit provided with a serrated edge. The spindle is screw-threaded at into a knob, rotation of which enables the paper to be dispensed. Unscrewing of cap enables the roll to be renewed or replaced. The lower end of the spindle is received in member, FIG. 2.

The pen includes a segmented roll of paper E rolled inside a pen with a cover or Window B that can be closed or opened to expose the paper by means of a hinged door.

While these devices may be suitable for the purposes for which they were designed, they would not be as suitable for the purposes of the present invention, as hereinafter described.

SUMMARY OF THE PRESENT INVENTION

The present invention discloses a housing having a longitudinal slot passing therethrough communicating with a housing cavity that has a spool positioned therein with flexible sheet material wound on the spool which is extendable and retractable through the longitudinal slot by means of an exteriorly located clip fastened to the distal end of the flexible sheet material having means for selectively holding the material in the extended position. The device can be manufactured as an integral part of a writing implement of or as an accessory for a writing implement such as a pen cover. The mechanism for extending and retracting the flexible sheet material is not limited to that disclosed in the drawing and can include the mechanism commonly found in window shades.

A primary object of the present invention is to provide a device having means for extending a flexible sheet material through a slot from an internal spool.

Another object of the present invention is to provide means for selectively stopping the flexible sheet material in the extended position.

Yet another object of the present invention is to provide means for selectively retracting the flexible sheet material from the extended position.

Still yet another object of the present invention is to provide said device with a writing implement such as a pen Another object of the present invention is to provide said device within a cap that can be used on various type of writing implements.

Yet another object of the present invention is to provide an extendable retractable flexible sheet material having indicia, graphic image and/or picture thereon mounted on a spool within a housing bore.

Still yet another object of the present invention is to provide a housing with a longitudinal slot providing access to a spool positioned within the housing bore having means for selectively extending and retracting flexible sheet material having one end fixedly attached to the bore.

Additional objects of the present invention will appear as the description proceeds.

The present invention overcomes the shortcomings of the prior art by providing a housing having a longitudinal slot passing therethrough communicating with a housing cavity that has a spool positioned therein with flexible sheet material wound on said spool which is extendable and retractable through said longitudinal slot by means of an exteriorly located clip fastened to the distal end of the flexible sheet material having means for selectively holding the material in the extended position. The device can be manufactured as an integral part of a writing implement of as an accessory for a writing implement such as a pen cover.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
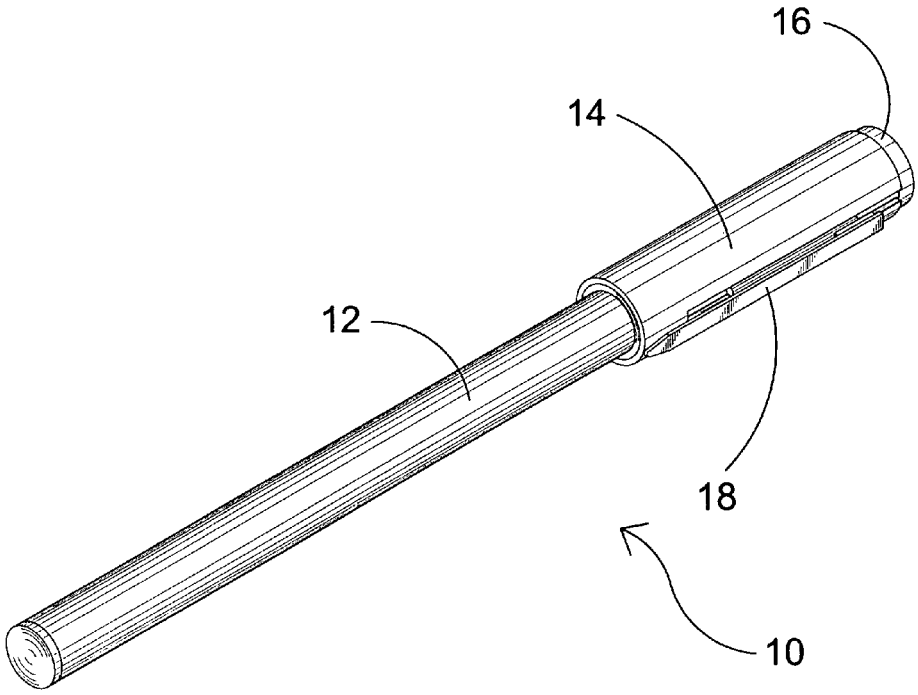
FIG. 1 is a perspective view of the present invention.

With regard to reference numerals used, the following numbering is used throughout the drawings.

10 present invention
12 barrel housing
14 cap assembly
16 end cap
18 pocket clip
20 pen tip
22 central core spindle
24 sheet
26 message
28 changeable part
30 fastening means
32 message spool
34 cylindrical member
36 carved sides
38 longitudinal slit
40 springs
42 rubber stop
44 end of message spool
46 aperture
48 spring lock port

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10. Shown is the present invention 10 being a combination writing instrument and information storage apparatus having an elongated barrel housing 12, an elongated tubular spindle, inserted in a first longitudinal chamber provided by the elongated barrel, having the tubular spindle providing a third longitudinal chamber therein, means for rotatably securing the elongated tubular spindle within the elongated barrel, an elongated cap assembly element 14 having a second longitudinal chamber therein, means for securing the elongated tubular spindle to the elongated cap element, cartridge type writing means adapted to reside within the coextensive first, second and third longitudinal chambers, means for extending and retracting the writing means and a flexible sheet fixedly attached to the outer surface of the spindle and extending outwardly through a longitudinal aperture provided in the elongated barrel, rotation of the spindle retracting and extending the flexible sheet. At the end of the flexible sheet, a rubber stop is provided, allowing the extended sheet to stay in an extended position until a slight tug allows the message sheet to retract. Also shown are the end cap 16 and pocket clip 18.

Figure 2:
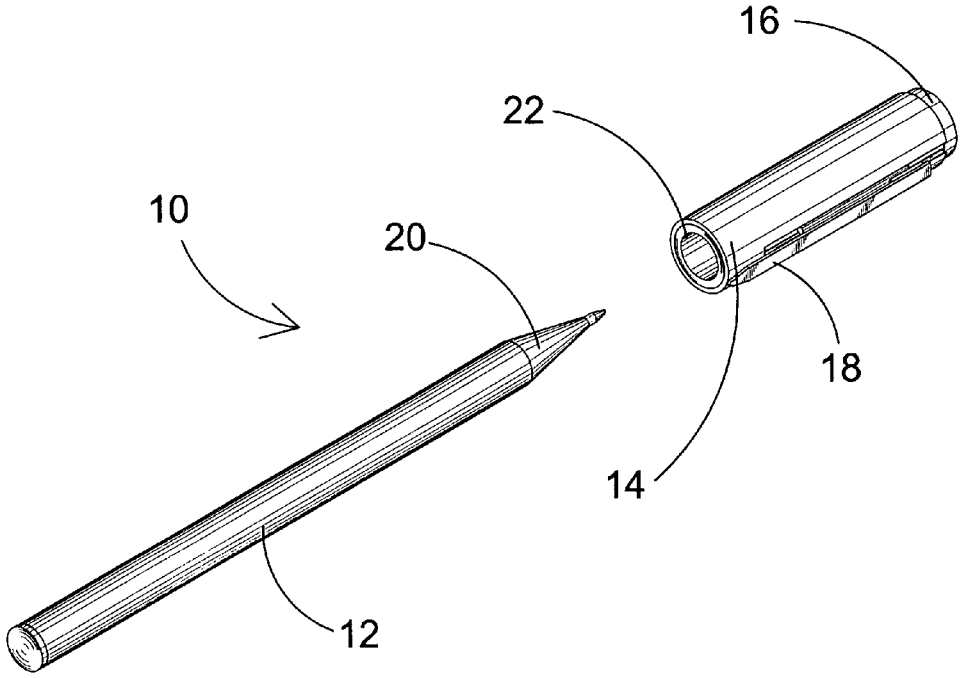
FIG. 2 is a perspective view of the present invention with the cap assembly removed.

Turning to FIG. 2, shown therein is a perspective view of the present invention 10 with the cap assembly 14 removed. Shown is the present invention 10 having the cap assembly 14 removed from the elongated barrel 12 containing a cartridge type writing means. Also shown are a pen tip 20, central core spindle 22, end cap 16 and pocket clip 18.

Figure 3:
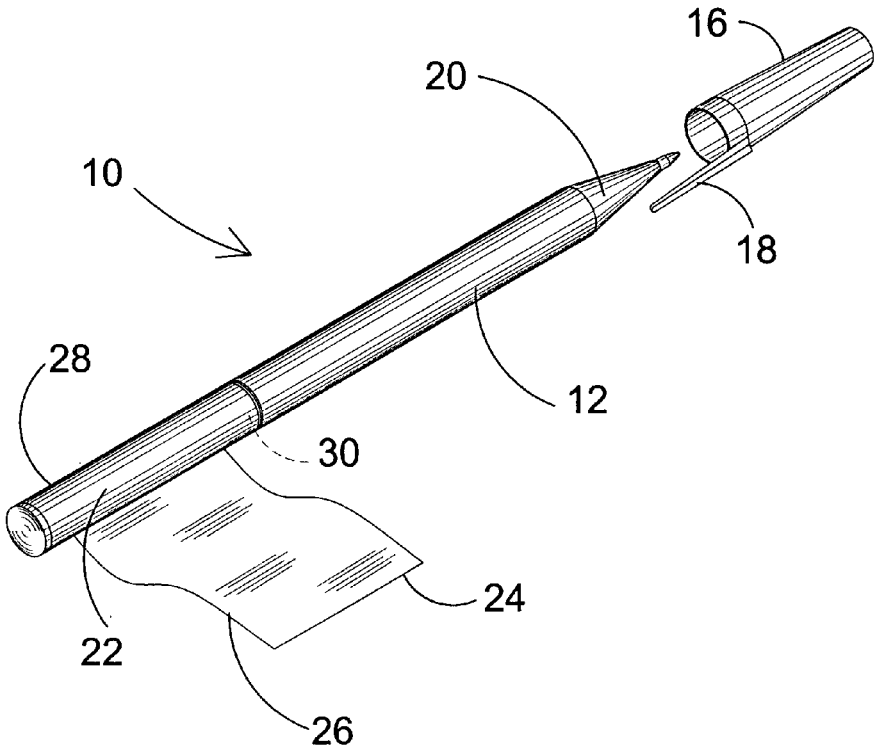
FIG. 3 is a perspective view of the present invention fastened to the barrel of a pen.

Turning to FIG. 3, shown therein is a perspective view of the present invention 10 fastened to the barrel of a pen. The present invention 10 is a pen card assembly having an extendible retractable flexible sheet material 24 for the placement thereon of some logo 26, graphic image, message or indicia. Once extended the assembly incorporates a holding means for fixedly positioning the sheet material 24 in the extended position. The extendible retractable mechanism can be as illustrated in the following drawings or can be similar to the mechanism used in window shades. Also, the device can be incorporated as part of the pen or, as illustrated, a mechanism that can be fastened with means 30 to a pen, such as threaded. Also shown are the changeable part 28 and other previously disclosed elements.

Figure 4:
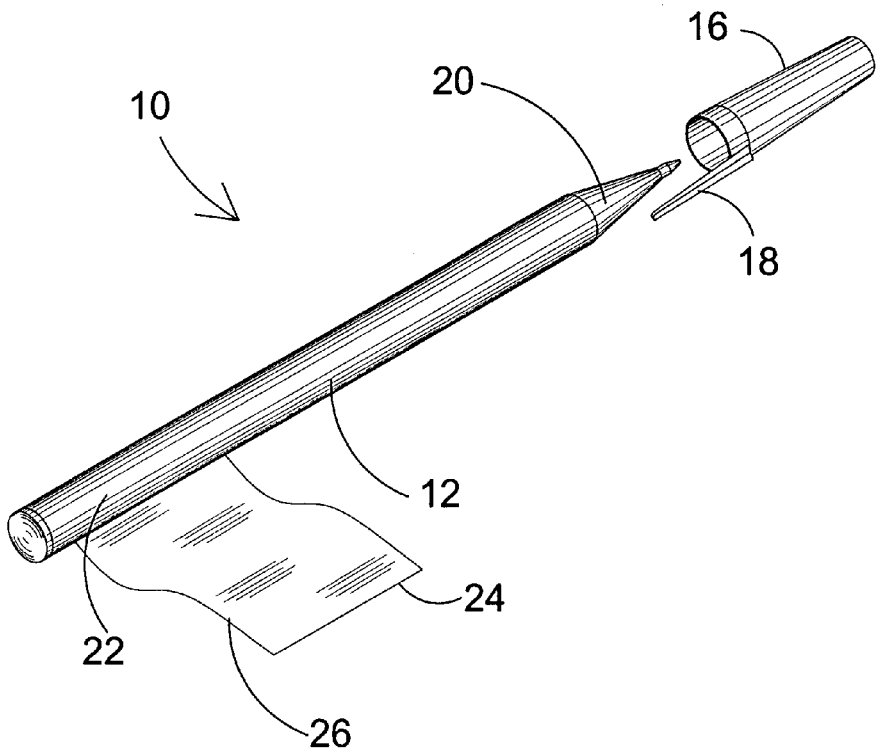
FIG. 4 is a perspective view of the present invention incorporated into the barrel of a pen.

Turning to FIG. 4, shown therein is a perspective view of the present invention 10 incorporated into the barrel 12 of a pen. The present invention 10 is a pen card assembly having an extendible retractable flexible sheet material 24 for the placement thereon of some logo 26, graphic image or indicia. Once extended the assembly incorporates a holding means for fixedly positioning the sheet material 24 in the extended position. The extendible retractable mechanism can be as illustrated in the following drawings or can be similar to the mechanism used in window shades. Also, the assembly can be incorporated as part of the pen or as previously illustrated a mechanism that can be fastened with means 30 to a pen, such as threaded. Other previously disclosed elements are also shown.

Figure 5:
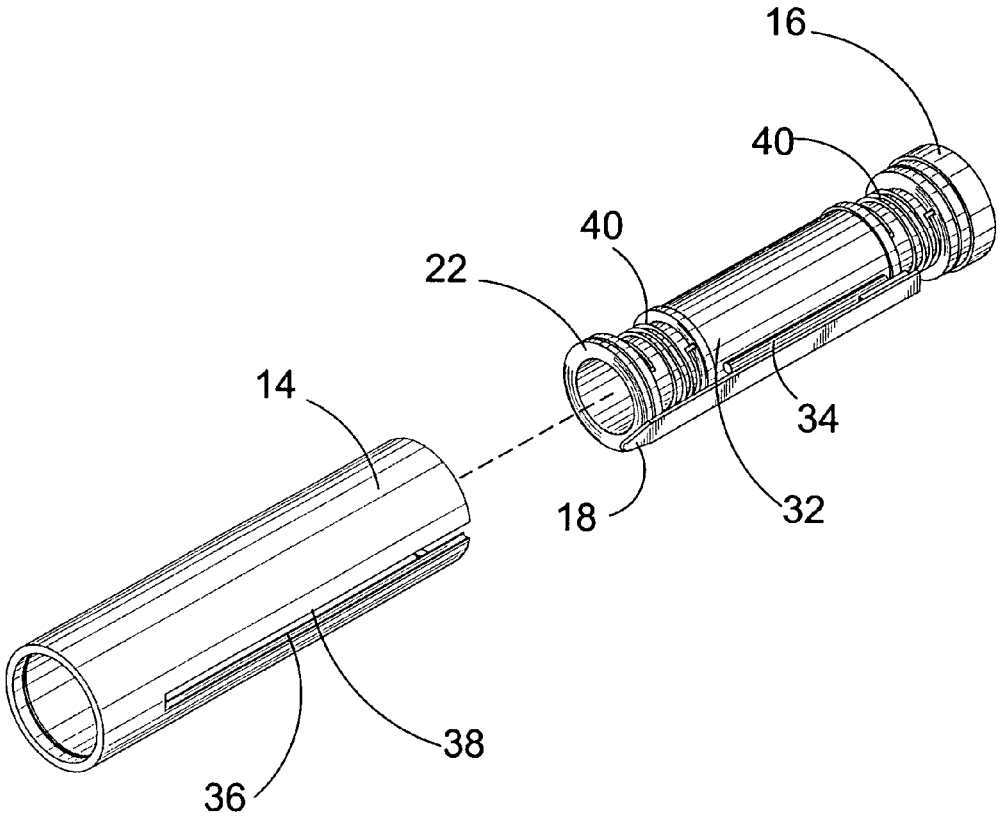
FIG. 5 is a perspective view of the present invention with cap housing removed from the central core spindle.

Turning to FIG. 5, shown therein is a perspective view of the present invention with cap housing 14 removed from the central core spindle 22. Shown is the cap housing 14 removed from the central core spindle 22, revealing the message spool 32 and cylindrical member 34 having means for extending and retracting the flexible message sheet which is fixedly attached to the outer surface of the spindle 22. To extend the sheet, the pocket clip 18 is pulled outwardly until a rubber stop prevents any further pull, then to retract, a slight tug is required to release the rubber stop and retract the message sheet. Also shown are curved sides 36, longitudinal slit 38, two springs 40 and end cap 16.

Figure 6:
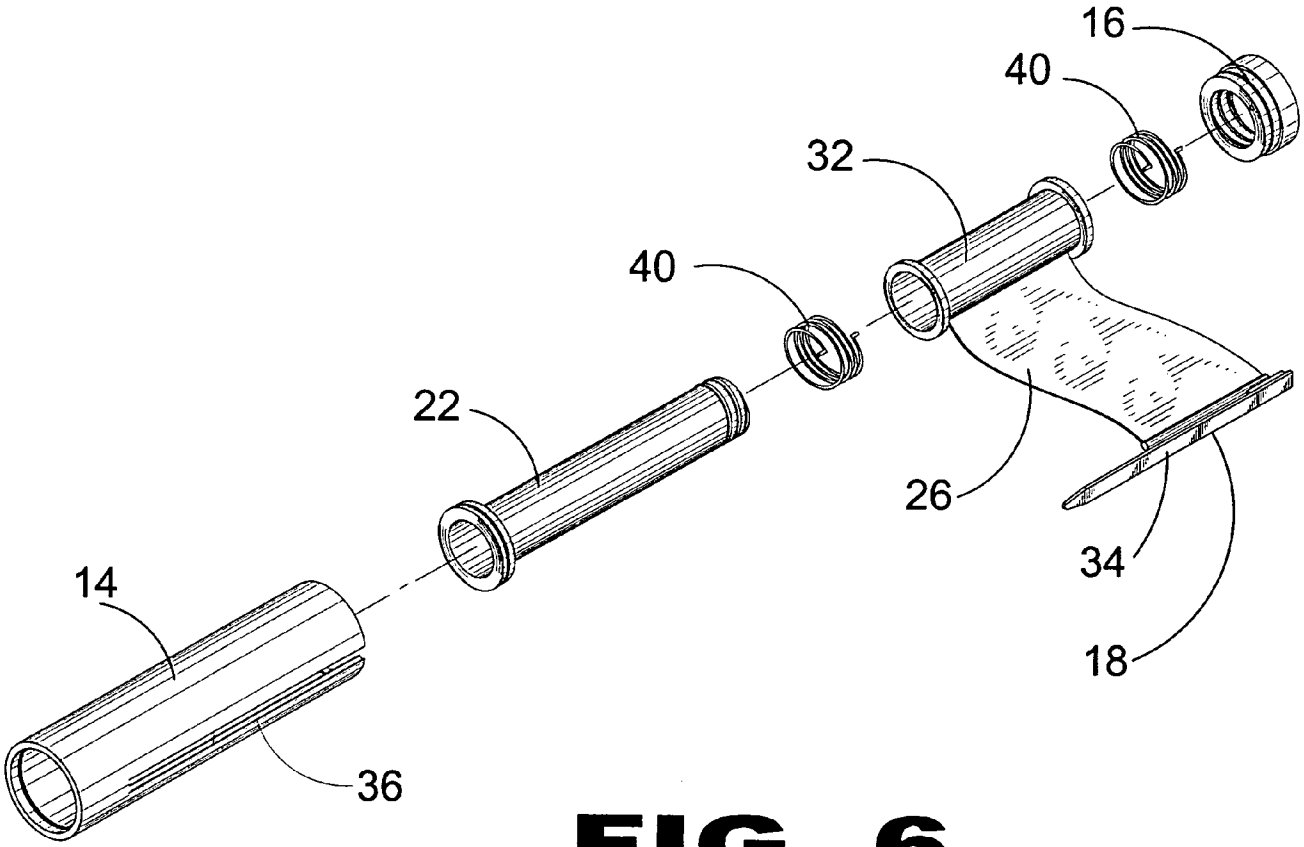
FIG. 6 is an exploded view of the present invention.

Turning to FIG. 6, shown therein is an exploded view of the present invention. Shown is an exploded view of the present invention showing the internal components in relation to each other. The previously disclosed elements are also shown.

Figure 7:
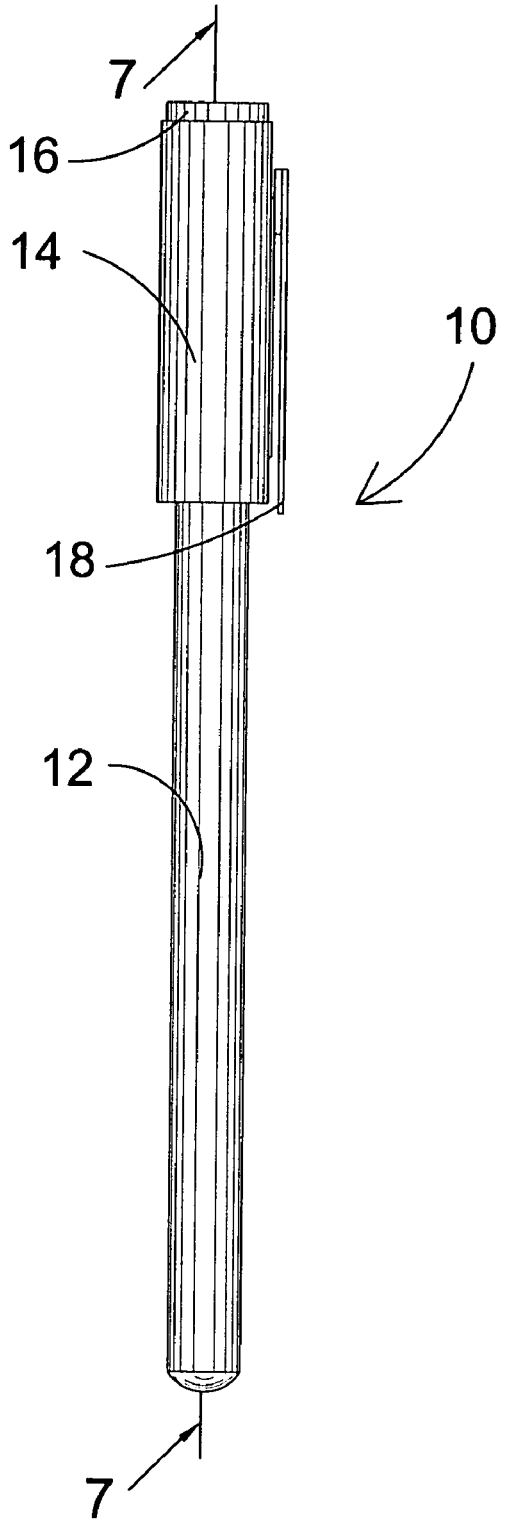
FIG. 7 is a side view of the present invention.

Turning to FIG. 7, shown therein is a side view of the present invention 10. Shown is the present invention 10 being a combination writing instrument and information storage apparatus having an elongated barrel 12, an elongated tubular spindle, inserted in a first longitudinal chamber provided by the elongated barrel, the tubular spindle providing a third longitudinal chamber therein, means for rotatably securing the elongated tubular spindle within the elongated barrel, an elongated cap element 14 having a second longitudinal chamber therein, means for securing the elongated tubular spindle to the elongated cap element, cartridge type writing means adapted to reside within the coextensive first, second and third longitudinal chambers, means for extending and retracting the writing means and a flexible sheet fixedly attached to the outer surface of the spindle and extending outwardly through a longitudinal aperture provided in the elongated barrel, rotation of the spindle retracting and extending the flexible sheet. At the end of the flexible sheet, a rubber stop is provided, allowing the extended sheet to stay in an extended position until a slight tug allows the message sheet to retract. Other previously disclosed elements are also shown.

Figure 8:
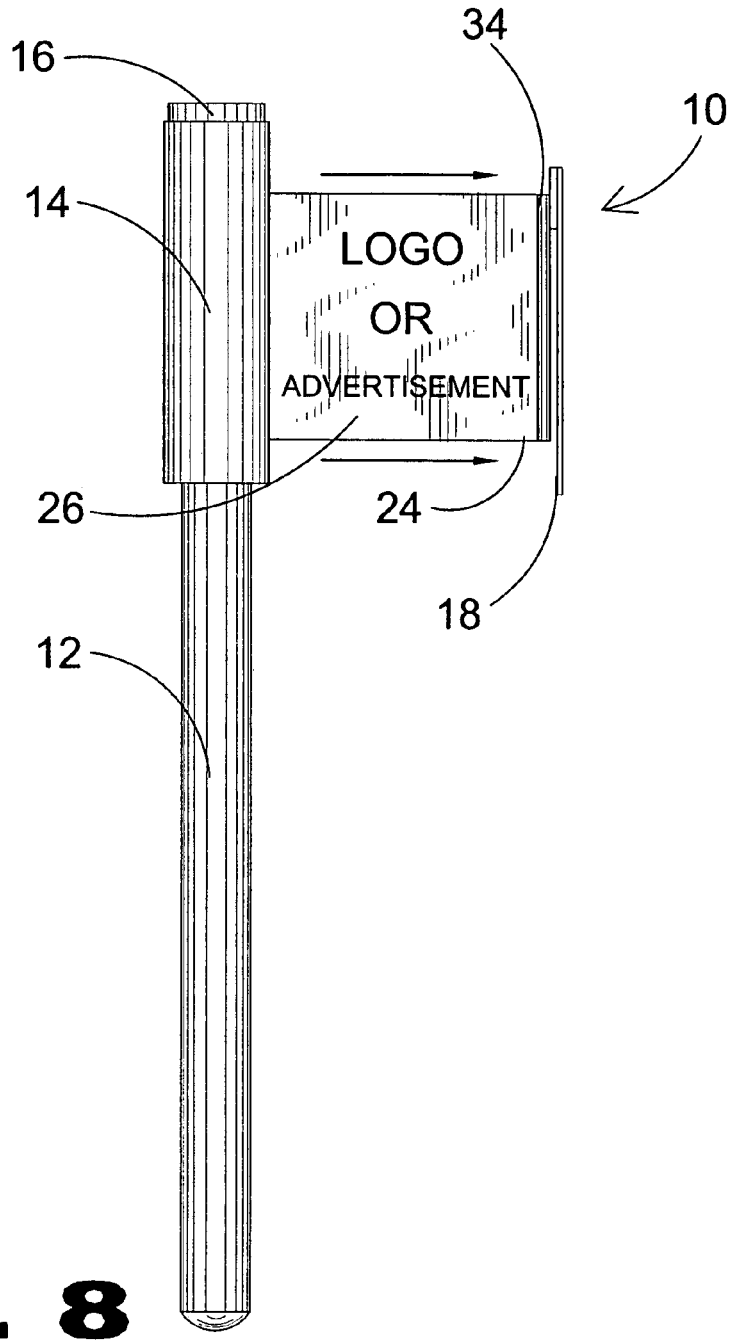
FIG. 8 is a side view of the present invention with the message sheet extended.

Turning to FIG. 8, shown therein is a side view of the present invention 10 with the message sheet extended. Shown is the present invention 10 being a combination writing instrument and information storage apparatus having means for extending and retracting the writing means and a flexible sheet 24 fixedly attached to the outer surface of the spindle and extending outwardly through a longitudinal aperture provided in the elongated barrel 12, rotation of the spindle retracting and extending the flexible sheet 24. At the end of the flexible sheet 24, a rubber stop is provided, allowing the extended sheet to stay in an extended position until a slight tug allows the spring to retract the message sheet. Other previously disclosed elements are also shown.

Figure 9:
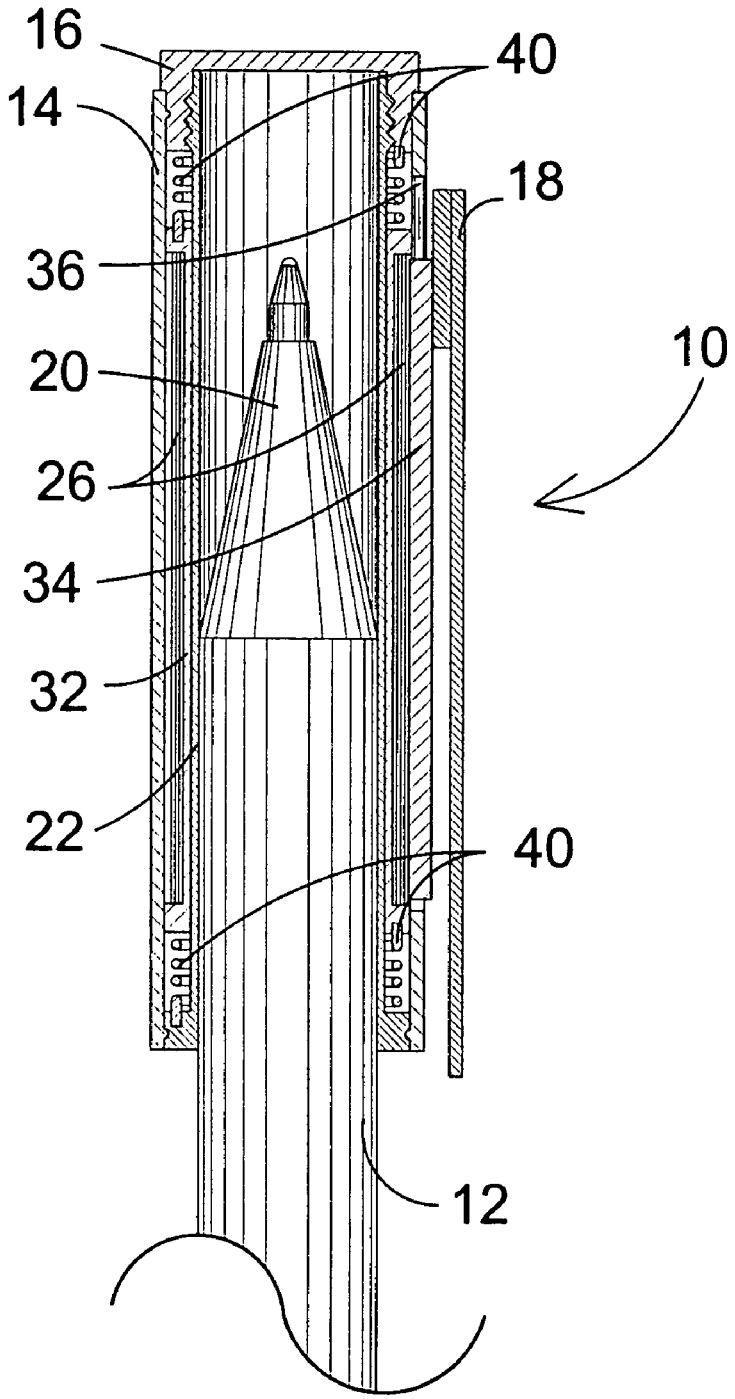
FIG. 9 is a sectional view of the present invention.

Turning to FIG. 9, shown therein is a sectional view of the present invention 10. Shown is the present invention 10 being a combination writing instrument and information storage apparatus having an elongated barrel 12, an elongated tubular spindle 22, inserted in a first longitudinal chamber provided by the elongated barrel, the tubular spindle providing a third longitudinal chamber therein, means for rotatably securing the elongated tubular spindle within the elongated barrel, an elongated cap element having a second longitudinal chamber therein, means for securing the elongated tubular spindle to the elongated cap element 14, cartridge type writing means adapted to reside within the coextensive first, second and third longitudinal chambers, means for extending and retracting the writing means and a flexible sheet with message 26 fixedly attached to the outer surface of the spindle and extending outwardly through a longitudinal aperture provided in the elongated barrel, rotation of the spindle retracting and extending the flexible sheet. At the end of the flexible sheet, a rubber stop is provided, allowing the extended sheet to stay in an extended position until a slight tug allows the message sheet to retract. Other previously disclosed elements are also shown.

Figure 10:
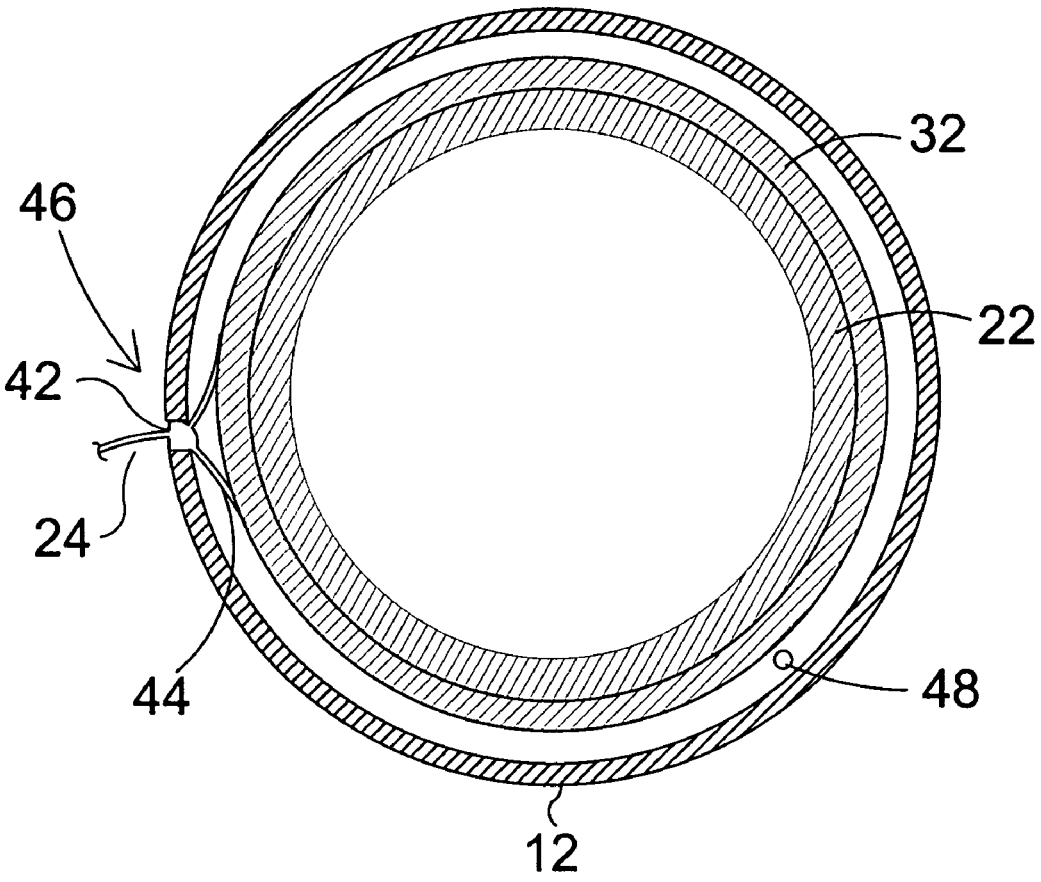
FIG. 10 is a sectional view of the present invention.

Turning to FIG. 10, shown therein is a sectional view of the present invention. Shown is a sectional view of the present invention having a rubber locking stop 42 provided at the end of the message scroll 44. When the scroll 24 is pulled to its end, the rubber stop 42 locks within the housing scroll aperture 46 preventing the scroll from retracting. To retract the scroll 24, a light tug is required to release the stop 42, allowing the spring to retract the scroll. Also shown are spring lock port 48 and other previously disclosed elements.

What is claimed to be new and desired to be protected by Letters Patent is set forth in the appended claims.

I claim:

1. An apparatus for a combination writing instrument and information storage device, comprising:

a) an elongated barrel having first and second opposing ends, a writing tip being disposed on said first end;

b) a cap housing being disposed on said first end of said barrel to protect said writing tip, wherein said cap housing has first and second ends wherein said first end is closed and said second end is open, wherein said cap housing has a pocket clip disposed thereon, wherein said cap housing has a longitudinal slit therein, wherein said slit is disposed in the wall of said cap housing;

c) a central spindle having first and second ends being disposed in said cap housing, wherein said spindle has a throughbore therein, wherein said first end of said spindle is oriented toward said first end of said cap housing, wherein said writing tip may be disposed in said throughbore of said central spindle;

d) a message spool having first and second ends being rotatably disposed on said spindle, wherein said message spool has a throughbore therein, wherein said spindle is disposed in said throughbore of said message spool, wherein said first end of said message spool is oriented toward said first end of said spindle;

e) a message scroll having first and second ends being disposed on said message spool, wherein said message scroll is wound onto said message spool, wherein said second end of said message scroll is fixedly attached to said message spool and said first end of said message scroll passes through said longitudinal slit in said cap, wherein said message scroll is wound onto said message spool in a first position, and wherein said message scroll is extended through said longitudinal slit in a second position;

f) wherein said first end of said message scroll is attached to said pocket clip to permit the message scroll to be extended from the message spool by pulling on the pocket clip;

g) an end cap being disposed on said second end of said cap housing, wherein said end cap has a throughbore therein, wherein said throughbore of said end cap may receive said writing tip therethrough, wherein said end cap secures said message spool in said cap housing;

h) spring means being disposed on said first and second ends of said message spool whereby the message scroll can be rewound to the first position after being extended to the second position; and, i) lock means being disposed on said message scroll whereby the message spool can be locked in the second position and then released from the second position to return to the first position.

2. The apparatus of claim 1, further comprising a cylindrical member being disposed on said first end of said message scroll, wherein said cylindrical member is attached to said pocket clip to permit the message scroll to be extended from the message spool by pulling on the pocket clip.

3. The apparatus of claim 2, wherein said spring means comprises:

a) a helical spring disposed on said first and second ends of said message spool, each helical spring being formed of material having first and second ends, wherein each of said first and second ends of each of said first and second springs has a tip thereon, wherein said first spring is disposed between said first end of said spindle and said first end of said message spool, and said second spring is disposed between said second end of said spindle and said end cap;

b) wherein said tip on said first end of said first spring is adapted for connection to said first end of said spindle and said tip on said second end of said first spring is adapted for connection to said first end of said message spool, wherein said first spring biases said message spool toward said first position so that the message scroll is retracted; and, c) wherein said tip on said first end of said second spring is adapted for connection to said end cap and said tip on said second end of said second spring is adapted for connection to said second end of said message spool, wherein said second spring biases said message spool toward said first position so that the message scroll is retracted.

4. The apparatus of claim 3, wherein said lock means comprises:

a) an enlarged stop being disposed adjacent said second end of said message scroll so that said stop will not pass through said longitudinal slit; and, b) wherein said stop will engage said longitudinal slit in a first position and then after said message scroll is tugged on and released will allow said message scroll to retract to said first position of said message scroll.

5. The apparatus of claim 4, wherein said message scroll has a message therein.

6. The apparatus of claim 5, wherein said message scroll has a logo therein.

* * * * *